US008690475B2

(12) United States Patent
Springer

(10) Patent No.: US 8,690,475 B2
(45) Date of Patent: Apr. 8, 2014

(54) COMPACTION APPARATUS AND ASSOCIATED COMPACTOR VEHICLE

(75) Inventor: Steven D Springer, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 153 days.

(21) Appl. No.: 12/898,058

(22) Filed: Oct. 5, 2010

(65) Prior Publication Data

US 2012/0082513 A1 Apr. 5, 2012

(51) Int. Cl.
*E01C 19/26* (2006.01)

(52) U.S. Cl.
USPC ..... 404/121

(58) Field of Classification Search
USPC ..... 404/121, 122, 124; 172/535, 537, 539, 172/540, 554, 556; 301/43
See application file for complete search history.

(56) References Cited

U.S. PATENT DOCUMENTS

| | | | | |
|---|---|---|---|---|
| 895,230 | A * | 8/1908 | Beier | 172/554 |
| 1,406,562 | A * | 2/1922 | Hruby | 301/44.3 |
| 1,560,295 | A * | 11/1925 | Keeler | 404/124 |
| 3,823,983 | A * | 7/1974 | Peterson | 301/43 |
| 4,302,129 | A * | 11/1981 | Arenz | 404/117 |
| 5,360,288 | A * | 11/1994 | O'Neill et al. | 404/129 |
| 5,511,901 | A | 4/1996 | Yates | |
| 6,095,717 | A | 8/2000 | Kaldenberg et al. | |
| 6,390,204 | B1 * | 5/2002 | Schafle | 172/554 |
| 6,632,045 | B1 * | 10/2003 | McCartney | 404/72 |
| 8,007,200 | B2 * | 8/2011 | Brockway | 404/124 |
| 2002/0114667 | A1 * | 8/2002 | Kaldenberg et al. | 404/124 |
| 2005/0152745 | A1 * | 7/2005 | Livesay et al. | 404/124 |
| 2005/0225162 | A1 * | 10/2005 | Gibbins | 301/43 |
| 2006/0255653 | A1 | 11/2006 | Gibbins | |
| 2010/0247242 | A1 * | 9/2010 | Gibbins | 404/124 |
| 2011/0116866 | A1 * | 5/2011 | Brockway | 404/121 |

FOREIGN PATENT DOCUMENTS

| | | |
|---|---|---|
| EP | 1473412 | 11/2004 |

* cited by examiner

*Primary Examiner* — Thomas B Will
*Assistant Examiner* — Abigail A Risic
(74) *Attorney, Agent, or Firm* — Liell & McNeil

(57) ABSTRACT

A compaction apparatus includes a removable plate configured to at least partially cover an outermost arcuate surface of a wheel of a compactor vehicle. The plate defines a plurality of ports, each port being configured to receive at least a portion of a base of a compactor wheel projection.

20 Claims, 8 Drawing Sheets

COMPACTION APPARATUS AND ASSOCIATED COMPACTOR VEHICLE

TECHNICAL FIELD

The invention described herein relates to a compaction apparatus for compactor vehicles as well as the compactor vehicles themselves.

BACKGROUND

Compactor vehicles such as those used in landfills are frequently operated in harsh environments and experience a great deal of wear as a result. In particular, during use, wheels on landfill compactor vehicles commonly come into contact with rigid and sharp objects made of metal, wood, plastic, and other materials, and experience great, sometimes extreme wear. Such wheels must therefore be repaired, replaced, refurbished or otherwise renewed in order to continuing providing service.

U.S. Pat. No. 5,511,901 to Yates discloses a removable shell for changing the outer surface of the primary drum of a compacting machine from a planar to a padfoot surface. The shell is flexibly deformed into frictional engagement with the outer surface of the primary drum of the compacting machine. The shell in Yates includes padfeet, thereby requiring the shell and the padfeet to be replaced simultaneously, which in turn increases the complexity and expense of manufacturing, distribution, and installation.

SUMMARY

A compaction apparatus disclosed herein includes a removable plate configured to at least partially cover an outermost arcuate surface of a wheel of a compactor vehicle. The plate defines a plurality of ports, each port being configured to receive at least a portion of a base of a compactor wheel projection.

A compaction apparatus disclosed herein includes a removable plate configured to at least partially cover an outermost arcuate surface of a wheel of a compactor vehicle. The plate defines a plurality of ports including a plurality of port pairs, and further defines a plurality of voids, each void being positioned substantially between the two ports of a port pair in the plurality of port pairs. The apparatus further includes a plurality of compactor wheel projections each having a base, wherein the base of each compactor wheel projection includes two feet configured to be received by one port pair in the plurality of port pairs, and wherein each void defined by the plate is positioned to be substantially covered by the base of one of the plurality of compactor wheel projections.

A compactor vehicle disclosed herein includes a plurality of wheels and a compaction apparatus on at least one wheel in the plurality of wheels. The compaction apparatus includes a removable plate at least partially covering an outermost arcuate surface of the at least one wheel. The plate defines a plurality of ports, each port being configured to receive at least a portion of a base of a compactor wheel projection.

DETAILED DESCRIPTION

Figure 1:
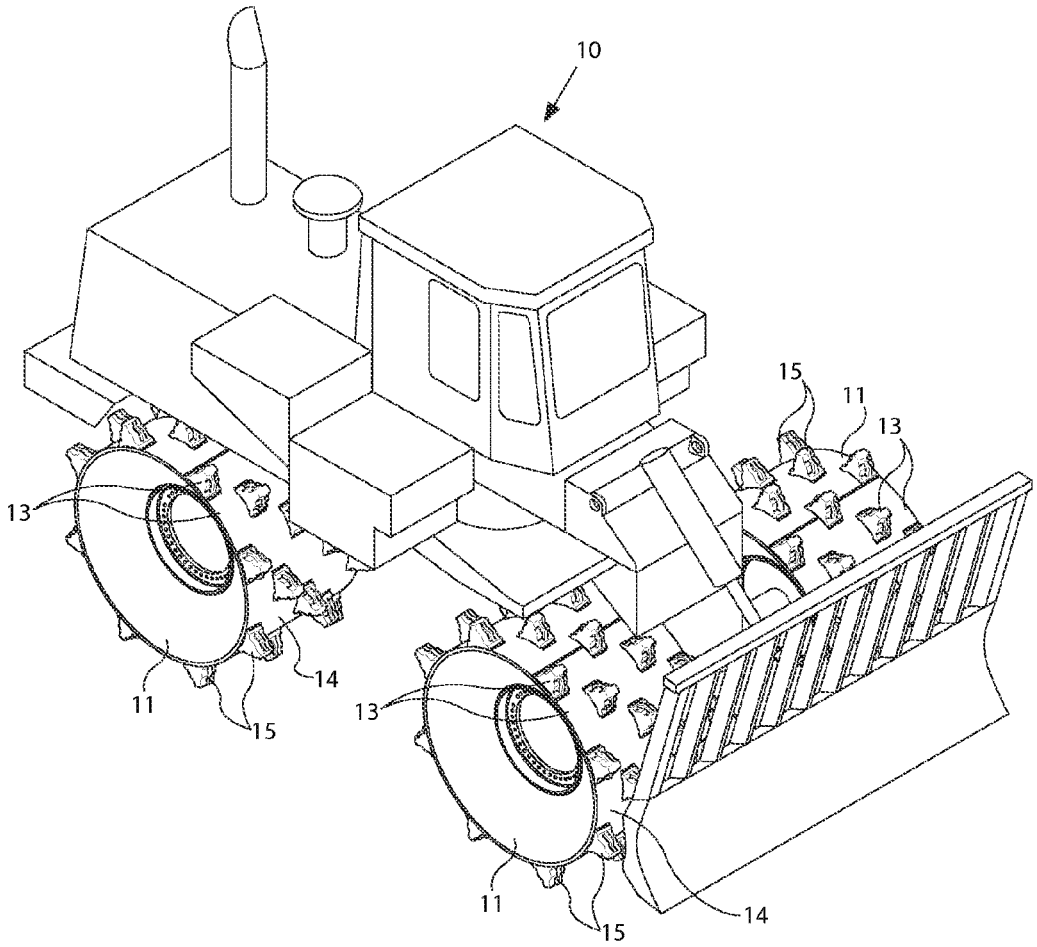
FIG. 1 is a perspective view of a compactor vehicle according to an embodiment of the invention, the compactor vehicle including a compaction apparatus according to a first embodiment of the invention.
Figure 3:
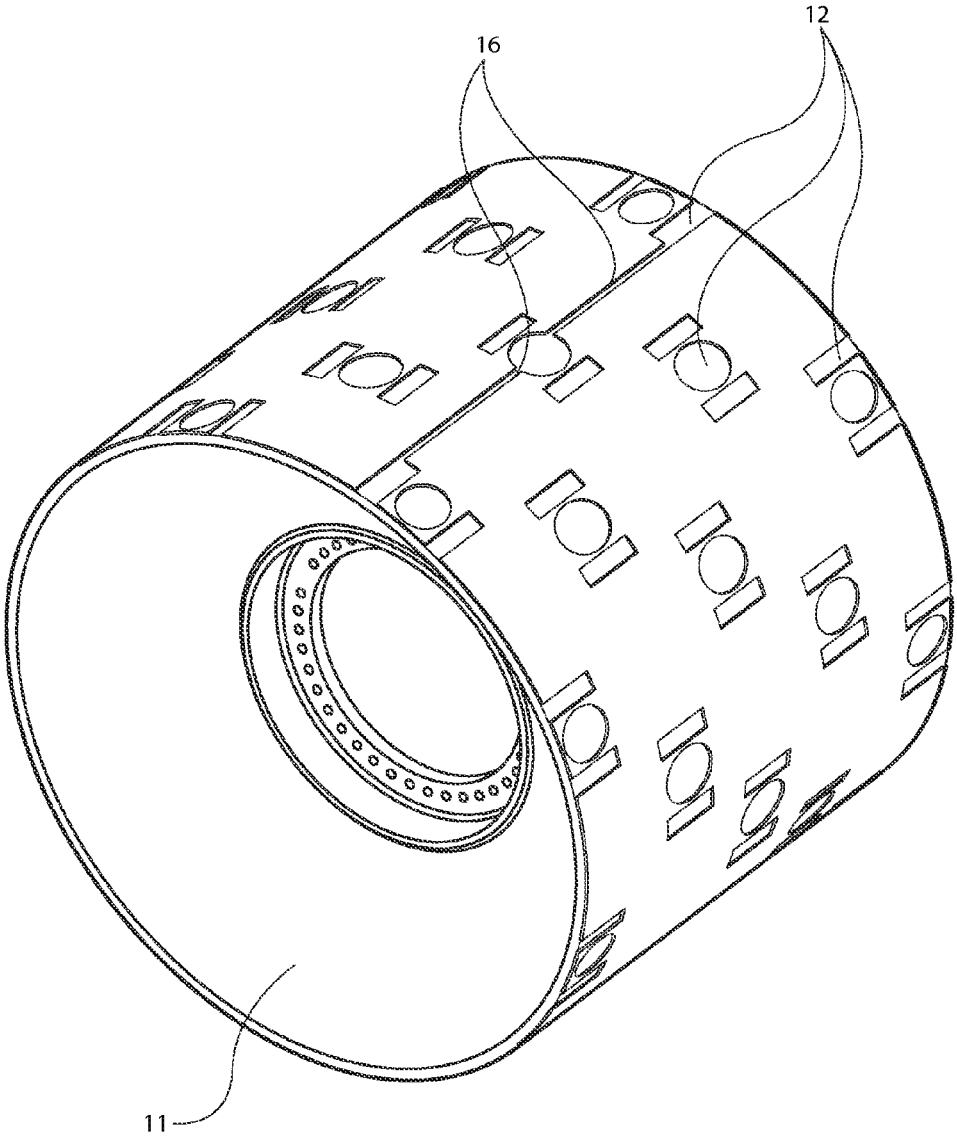
FIG. 3 is the perspective view shown in FIG. 2, but with the compactor wheel projections of the compaction apparatus removed.

A compactor vehicle, specifically a landfill compactor vehicle, is shown broadly at reference numeral 10 in FIG. 1. The compactor vehicle 10 includes a plurality of wheels 11. Each wheel 11 has an outermost, substantially cylindrical surface 12 (FIG. 3).

Figure 2:
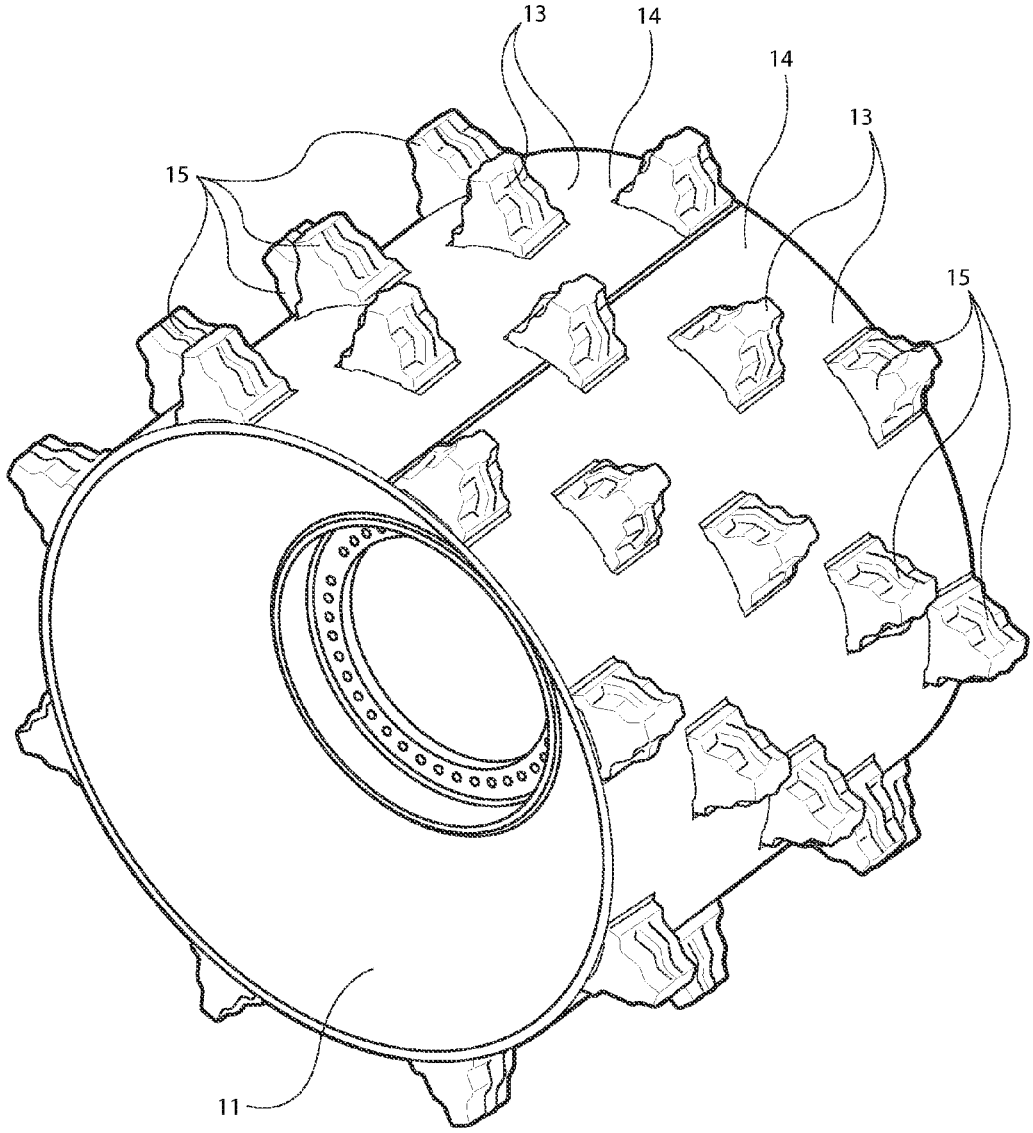
FIG. 2 is a perspective view of a wheel of the compactor vehicle shown in FIG. 1 with the compaction apparatus shown in FIG. 1 attached thereto.

Turning to FIG. 2, a compaction apparatus 13 according to a first embodiment of the invention is attached to each of the wheels 11. The compaction apparatus 13 includes at least one removable plate 14 and a plurality of compactor wheel projections 15. The projections 15 may have any one of a number of designs and are sometimes referred to as tips, pad feet, or sheep's feet by those of ordinary skill in the art. The plate 14 is configured to at least partially cover the outermost surface 12 of the wheel 11 and to engage material needing compaction, such as waste, garbage, and trash in a landfill (not shown) or soil on a worksite. As shown in FIG. 3, a plurality of plates 14 is utilized to cover substantially the entire outermost surface 12 of the wheel 11; the specific number of plates 14 may vary depending on the sizes of the plates 14 and the wheel surface 12. In the illustrated embodiment, two plates 14 are utilized. The plates 14 may be secured to one another and to the wheel surface 12 along one or more seams 16 by welds, fasteners, adhesive, or any other means sufficient for the application.

Figure 4:
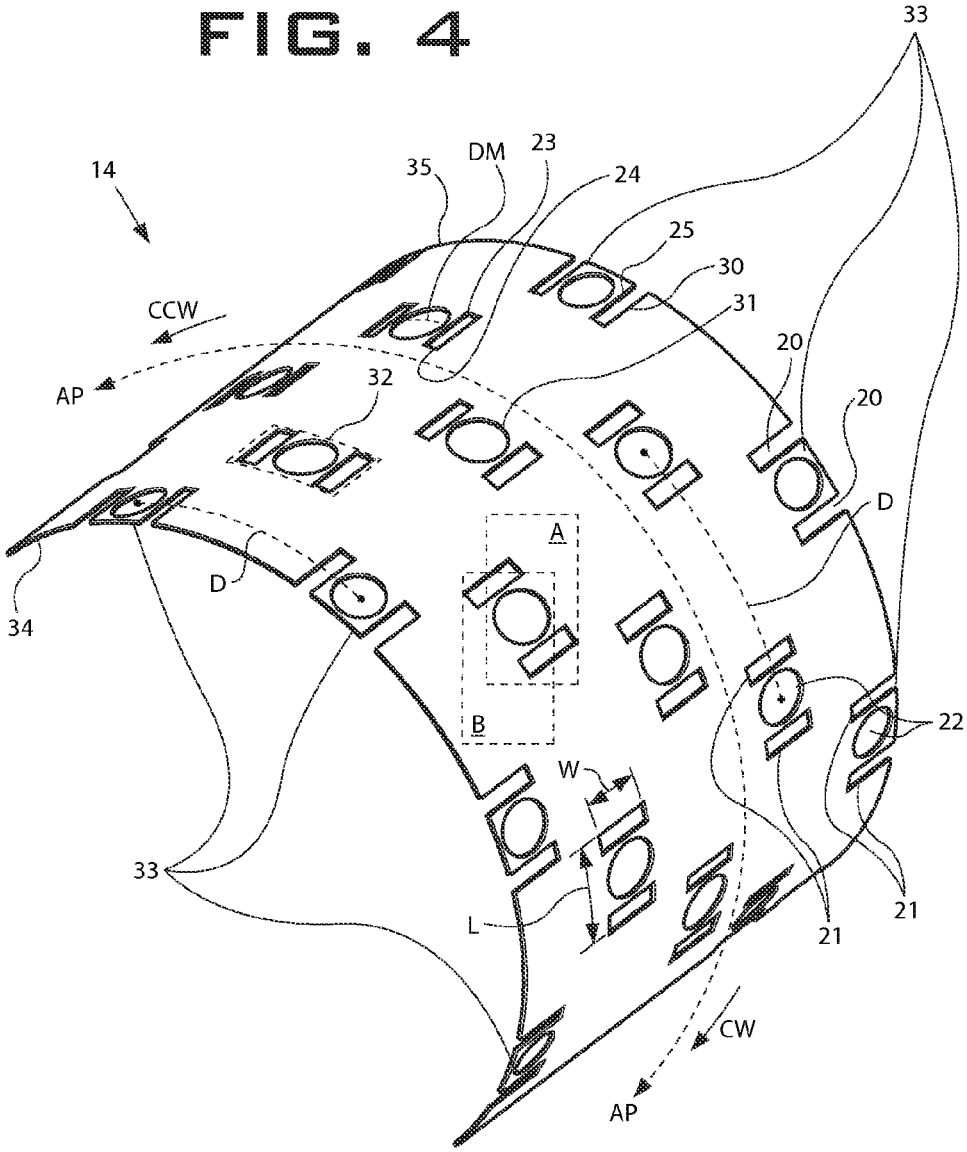
FIG. 4 is a perspective view of a plate of the compaction apparatus shown in FIGS. 1, 2, and 3.

Turning now to FIG. 4, one of the plates 14 is shown. The plate 14 defines a plurality of ports 20 including a plurality of port pairs 21, and further defines a plurality of voids 22, each void being positioned substantially between the two ports 20 of a port pair in the plurality of port pairs 21. Each of the ports 20 is substantially rectangular, having first and second minor sides 23, 24 substantially parallel to one another and first and second major sides 25, 30 substantially parallel to one another. Each of the voids 22 is substantially annular and has an annular periphery 31 defined by a diameter "DM". The ports 20 in each of the port pairs 21 are substantially tangential to, but do not intersect, the periphery 31 of one of the voids 22. Specifically, the ports 20 in each of the port pairs 21 are positioned approximately 180 degrees from one another along the annular periphery 31 of the corresponding void 22. Further, the first minor sides 23 of the ports 20 in each of the port pairs 21 substantially define a first plane "A" and the second minor sides 24 of the ports 20 in each of the port pairs 21 substantially define a second plane "B". The first and second planes "A", "B" are substantially parallel to one another and are substantially tangential to the periphery 31 of the corresponding void 22.

Figure 5:
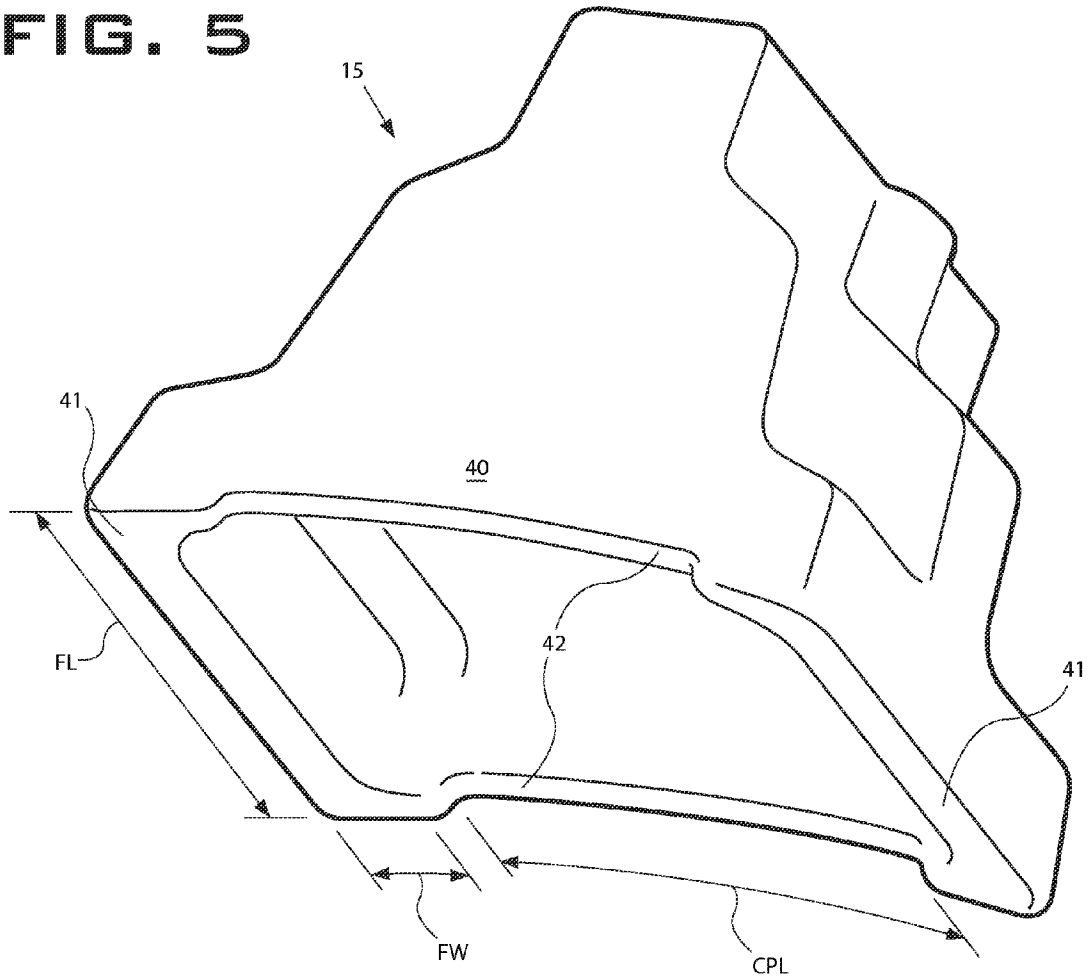
FIG. 5 is a perspective view of a compactor wheel projection of the compactor apparatus shown in FIGS. 1 and 2.

Each of the port pairs 21, together with the respective void 22, define a footprint 32 configured to receive one of the compactor wheel projections 15 (FIGS. 1, 2, and 5). More specifically, each of the footprints "F" is defined in part by the first and second planes "A", "B", which are themselves defined by the minor sides 23, 24 of the ports 20 in the corresponding port pair 21, as discussed above. The outermost major sides 25, 30 of the ports 20 in the corresponding port pair 21 cooperate with the first and second planes "A", "B" to further define each of the footprints 32. Each of the footprints 32 has a length "L" and a width "W", the lengths "L" of the plurality of footprints 32 being approximately equal to one another and the widths "W" of the plurality of footprints 32 being approximately equal to one another.

The footprints 32 are staggered along the plate 14 as follows. The plate 14 defines an arcuate profile "AP" and a plurality of substantially parallel footprint rows 33 along the arcuate profile "AP". Within each of the rows 33, adjacent footprints 32 are spaced apart from one another by a center-to-center distance "D". The distance "D" between adjacent footprints 32 in any given row in the plurality of rows 33 is approximately equal to the distance "D" between adjacent footprints 32 in any other row in the plurality of rows 33. The footprints 32 in adjacent rows 33 are staggered along the arcuate profile "AP" of the plate 14 by a distance approximately equal the length "L" of one of the footprints 32. For instance, in FIG. 4, moving from a near edge 34 of the plate 14 to a far edge 35 of the plate 14, adjacent rows 33 are shifted clockwise "CW" along the arcuate profile "AP" of the plate 14 by a distance approximately equal to the length "L" of one of the footprints 32; conversely, moving from the far edge 35 to the near edge 34 of the plate 14, adjacent rows 33 are shifted counterclockwise "CCW" along the arcuate profile "AP" of the plate 14 by a distance approximately equal to the length "L" of one of the footprints 32.

Turning now to FIG. 5, one of the plurality of compactor wheel projections 15 is shown. Each of the compactor wheel projections 15 includes a base 40 having two feet 41 and a center portion 42 between the two feet 41. The two feet 41 are configured to be received by one of the port pairs 21 and to substantially engage the outermost arcuate surface 12 of the wheel 11 of the compactor vehicle 10. Each of the feet 41 has a length "FL" approximately equal to the length of one of the major sides 25, 30 of one of the ports 20 and a width "FW" approximately equal to the length of one of the minor sides 23, 24 of one of the ports 20. The center portion 42 has a length "CPL" approximately equal to the diameter "DM" of one of the voids 22 defined by the plate 14. Accordingly, when the compactor wheel projection 15 is installed, the center portion 42 of the base 40 substantially covers the corresponding void 22 defined by the plate 14. The compactor wheel projection 15 may be installed using any one of a variety of methods, including welding and bolting.

Figure 6:
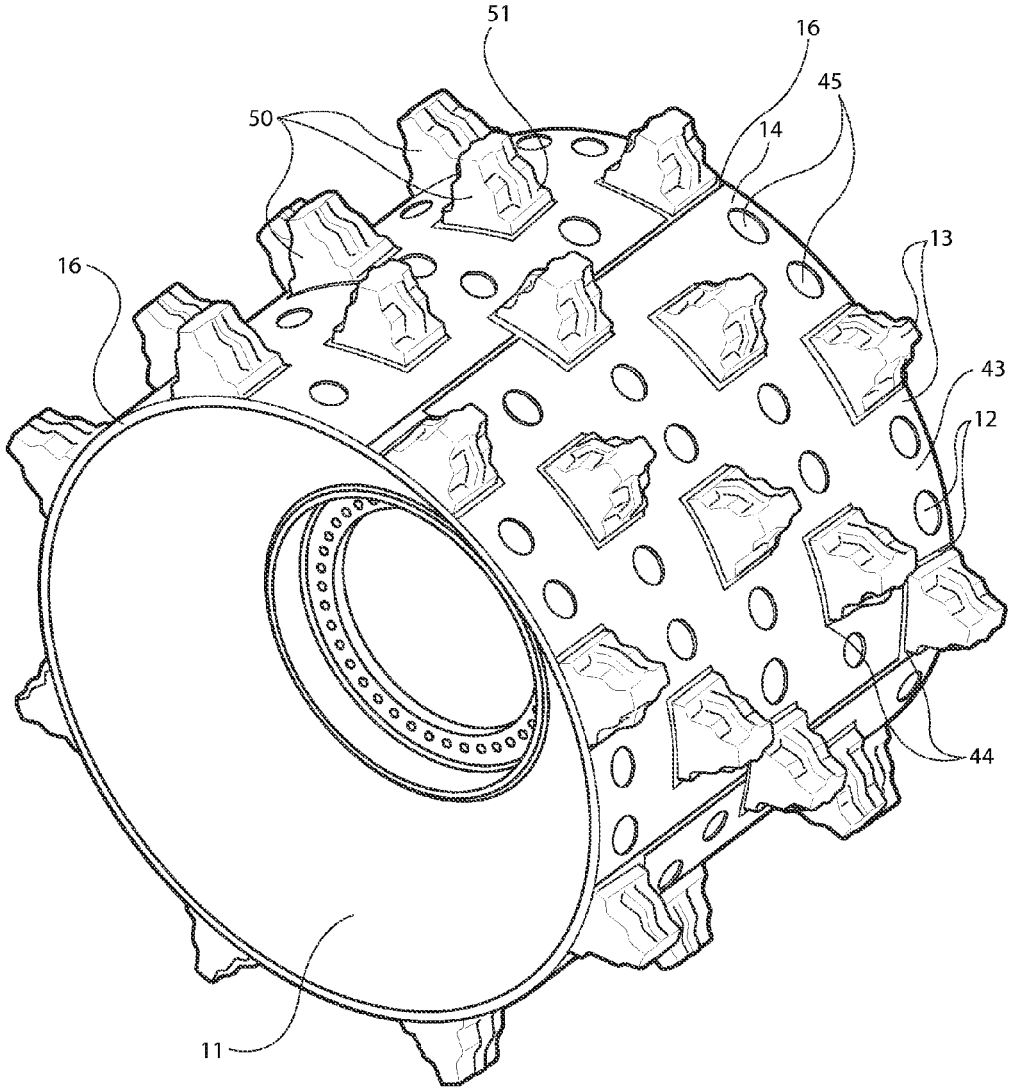
FIG. 6 is a perspective view of a wheel of a compactor vehicle with a compaction apparatus according to a second embodiment of the invention attached thereto.
Figure 7:
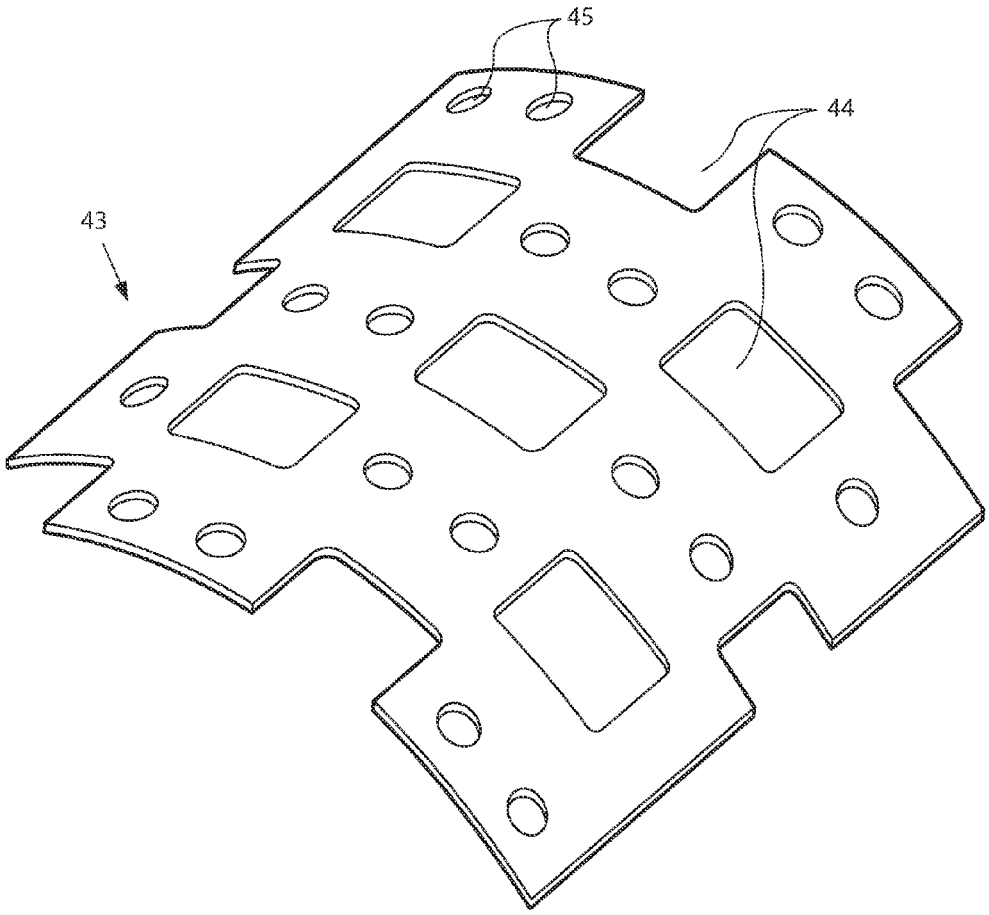
FIG. 7 is a perspective view of a plate of the compaction apparatus shown in FIG. 6.

Now looking at FIG. 6, a second embodiment of the compaction apparatus 13 of the invention is shown on the wheel 11 of the compactor vehicle 10. Like the first embodiment, this second embodiment includes a plate 43, shown by itself in FIG. 7, defining a plurality of ports 44 and a plurality of voids 45, and a compactor wheel projection 50 having a base 51. However, in this second embodiment substantially the entire bottom surface of the base 51 of the compactor wheel projection 50 is contoured to directly engage the wheel surface 12. Accordingly, the ports 44 defined by the plate 43 are each configured such that the base 51 of the compactor wheel projection 50 is inserted through the port 44 to directly engage the wheel surface 12. Substantially none of the portions of the plate 43 are interposed between the compactor wheel projection 50 and the wheel surface 12. Each of the ports 44 is substantially rectangular in order to accommodate substantially the entire bottom surface of the base 51 of the compactor wheel projection 50. The voids 45 in this second embodiment, instead of being oriented and configured to be substantially covered by the base 51 of the compactor wheel projection 50, are oriented between adjacent ports 44 and do not receive any portion of the compactor wheel projection 50. Rather, the voids 45 are configured to receive circular fillet welds (not shown) to help secure the plate 43 to the wheel surface 12.

However, in both embodiments the voids 45 are optional; the plate 14 (first embodiment) may define only the port pairs 21 and the plate 43 (second embodiment) may define only the ports 44 without departing from the scope of the invention. Further, in either embodiment, two or more plates 14, 43 may be utilized without departing from the scope of the invention; the two-plate illustration of the first embodiment and the four-plate illustration of the second embodiment are merely examples. While the geometric arrangement of compactor wheel projections in the two illustrated embodiments are substantially the same, any geometric arrangement of compactor wheel projections and corresponding geometric arrangement of ports may be utilized as desired for a given application.

INDUSTRIAL APPLICABILITY

Figure 8:
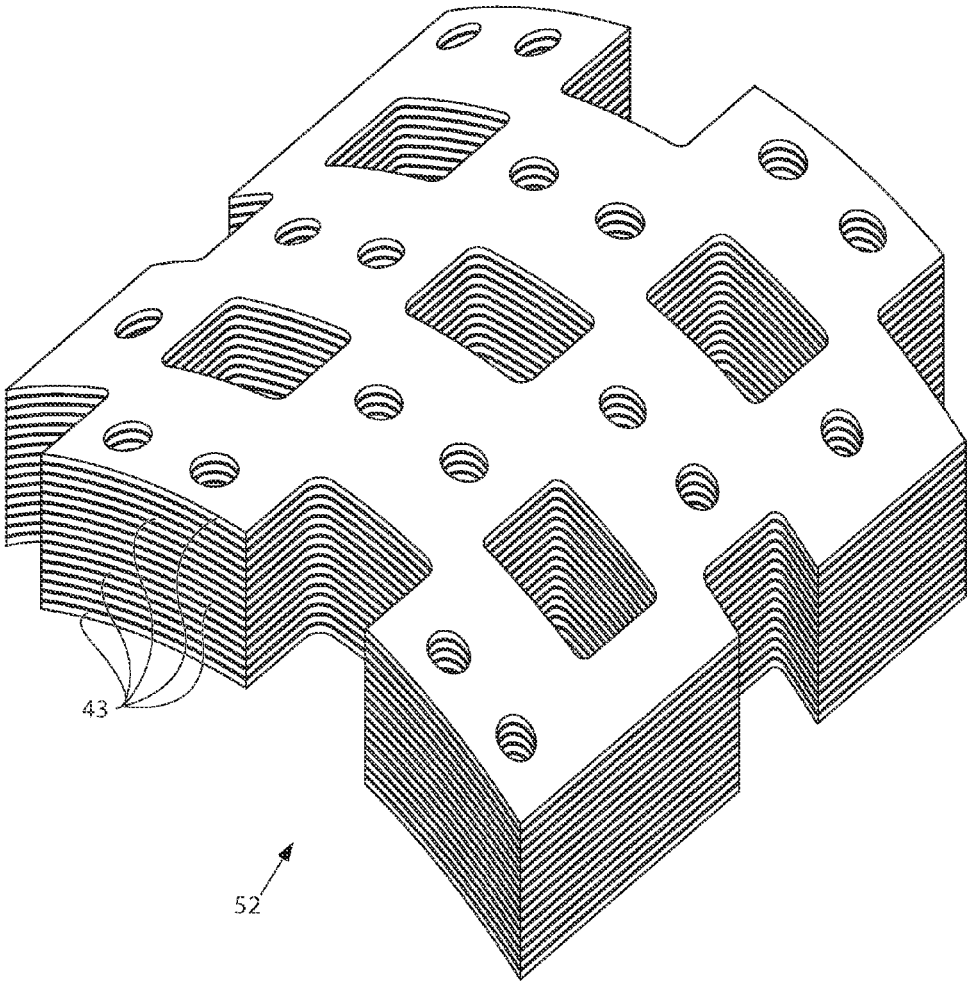
FIG. 8 is a perspective view of a plurality of plates in a stack, each plate of the plurality of plates in accordance with the plate shown in FIG. 7.

The plate of the compaction apparatus may be removed and replaced as necessary due to wear or damage. Specifically, if one of the plates on the wheel of the compactor vehicle is worn or damaged such that the outermost surface of the wheel is at risk of itself becoming worn or damaged, the compactor wheel projections engaging the plate to be replaced may be detached and the plate may then be removed. A new, less worn, or less damaged plate may then be installed in place of the removed plate. In this way, the plates provide a replaceable wear surface on the wheel of the vehicle, thereby preventing the entire wheel from needing replacement merely due to wear or damage of the wear surface. Further, providing multiple plates on the outermost surface of the wheel enables replacement of a targeted portion of the wear surface on the wheel without requiring replacement of the entire wear surface. In addition, as shown in FIG. 8, the plates may also be stacked on top of one another to form a stack 52, thereby bringing a reduction in the space needed for packaging, shipping, and storage relative to replaceable annular wear surfaces for entire wheels. The voids 22, 45 (FIGS. 4 and 6, respectively) in the two disclosed embodiments further reduce costs associated with the plate 43 by reducing the mass and weight of the plates.

Though the illustrated embodiment utilizes two plates and has the specific relative dimensions discussed herein, many alternative configurations could be utilized without departing from the scope of the invention. For instance, three or more plates could be used, the ports on the plates could be sized and distributed differently, and the plates could receive the compactor wheel projections in a different manner. These and other variations could all be utilized in any combination without departing from the scope of the invention, as the scope of the invention is set forth in the claims.

What is claimed is:

1. A compaction apparatus, comprising:

a removable plate configured to cover a first area of, and be secured to, an outermost arcuate surface of a wheel of a compactor vehicle;

the plate defining a plurality of rows that each include a plurality of rectangular ports that open to a second area of the arcuate surface that is exclusive of the first area, each port being configured to receive at least one of two feet of a base of a compactor wheel projection and engage the outermost arcuate surface of the wheel of the compactor vehicle and be attached with at least one of welds and bolts, and each of the two feet covering a portion of the second area; and each of the plurality of rows extending along an arcuate profile of the plate, and adjacent rows being staggered and shifted clockwise along the arcuate profile.

2. The compaction apparatus of claim 1, wherein the plurality of ports includes a plurality of port pairs, each port of the port pairs being configured to receive one of the two feet of the base of one compactor wheel projection; and each of the plurality of ports having a rectangular shape defined by minor sides extending transverse to the arcuate profile and major sides extending along the arcuate profile.

3. The compaction apparatus of claim 2, wherein the plate further defines a plurality of mass reduction voids that open to a third area of the arcuate surface that is exclusive of the first area, and each void is positioned substantially between the two ports of a port pair in the plurality of port pairs;

the base of one compactor wheel projection covering the void and a portion of the third area without being received therein.

4. The compaction apparatus of claim 3, wherein the two ports of the port pair and the void therebetween define a footprint, the footprint being one of a plurality of footprints defined by the plate, the lengths of the footprints in the plurality of footprints being approximately equal to one another.

5. The compaction apparatus of claim 1, wherein the plate further defines a plurality of mass reduction voids that open to a third area of the arcuate surface that is exclusive of the first area, and each void and a portion of the third area is configured to be substantially covered by the base of a compactor wheel projection, without the compactor wheel projection being received into the void.

6. The compaction apparatus of claim 1, further comprising a plurality of compactor wheel projections each having a base, wherein the base of each compactor wheel projection includes two rectangular feet configured to substantially engage the outermost arcuate surface of the wheel of the compactor vehicle, the two feet being further configured to be respectively received by two ports in the plurality of rectangular ports; and each of the rectangular feet having a width and a length approximately equal to a major side and a minor side, respectively, of each of the rectangular ports.

7. The compaction apparatus of claim 6, wherein the plate further defines a plurality of mass reduction voids that open to a third area of the arcuate surface that is exclusive of the first area, and each void and a portion of the third area is positioned to be substantially covered by the base of one of the plurality of compactor wheel projections, without the compactor wheel projection being received into the void.

8. The compaction apparatus of claim 2, wherein the plate further defines a plurality of mass reduction voids that open to a third area of the arcuate surface that is exclusive of the first area, and each void and a portion of the third area is positioned substantially between the two ports of a port pair in the plurality of port pairs.

9. A compaction apparatus, comprising:

a removable plate configured to cover a first area of, and be secured to, an outermost arcuate surface of a wheel of a compactor vehicle;

the plate defining a plurality of rows that each include a plurality of ports including a plurality of port pairs that open to a second area of the arcuate surface that is exclusive of the first area;

the plate further defining a plurality of mass reduction voids that open to a third area of the arcuate surface that is exclusive of the first area, each void and a portion of the third area being positioned substantially between the two ports of a port pair in the plurality of ports;

a plurality of compactor wheel projections each having a base, wherein the base of each compactor wheel projection includes two feet configured to be respectively received by one port pair in the plurality of port pairs and engage the outermost arcuate surface of the wheel of the compactor vehicle and be attached with at least one of welds and bolts, and wherein each void defined by the plate is positioned to be substantially covered by the base of one of the plurality of compactor wheel projections; and each of the plurality of rows extending along an arcuate profile of the plate, and adjacent rows being staggered and shifted clockwise along the arcuate profile.

10. A compactor vehicle, comprising:

a plurality of wheels that each include an outermost arcuate surface;

a compaction apparatus on at least one wheel in the plurality of wheels, the compaction apparatus comprising a removable plate covering a first area of, and secured to, the outermost arcuate surface of the at least one wheel, the plate defining a plurality of rows that each include a plurality of port pairs that open to a second area of the arcuate surface that is exclusive of the first area, each port being configured to receive at least one of two feet of a base of a compactor wheel projection and engage the outermost arcuate surface of the wheel of the compactor vehicle and be attached with at least one of welds and bolts; and each of the plurality of rows extending along an arcuate profile of the plate, and adjacent rows being staggered and shifted clockwise along the arcuate profile.

11. The compactor vehicle of claim 10, wherein the plurality of ports includes a plurality of port pairs, each port pair being configured to respectively receive two feet of the base of one compactor wheel projection; and each of the plurality of ports having a rectangular shape defined by minor sides and major sides.

12. The compactor vehicle of claim 11, wherein the plate further defines a plurality of mass reduction voids that open to a third area of the arcuate surface that is exclusive of the first area, and each void and a portion of the third area is positioned substantially between the two ports of a port pair in the plurality of port pairs.

13. The compaction apparatus of claim 12, wherein the two ports of the port pair and the void therebetween define a footprint, the footprint being one of a plurality of footprints defined by the plate, the lengths of the footprints in the plurality of footprints being approximately equal to one another.

14. The compactor vehicle of claim 10, wherein the plate further defines a plurality of mass reduction voids that open to a third area of the arcuate surface that is exclusive of the first area, and each void and a portion of the third area is configured to be substantially covered by the base of a compactor wheel projection.

15. The compactor vehicle of claim 10, further comprising a plurality of compactor wheel projections each having a base, wherein the base of each compactor wheel projection includes two feet configured to substantially engage the outermost arcuate surface of the at least one wheel, the two feet being further configured to be received by two ports in the plurality of ports; and each of the compactor wheel projections being attached with the at least one of welds and bolts.

16. The compactor vehicle of claim 15, wherein the plate further defines a plurality of mass reduction voids that open to a third area of the arcuate surface that is exclusive of the first area, and each void and a portion of the third area is positioned to be substantially covered by the base of one of the plurality of compactor wheel projections.

17. The compactor vehicle of claim 11, further comprising a plurality of compactor wheel projections each having a base, wherein the base of each compactor wheel projection includes two feet configured to be respectively received by one port pair in the plurality of port pairs;

each of the compactor wheel projections being attached to the compactor vehicle with the at least one of welds and bolts; and each of the feet having a width and a length approximately equal to a major side and minor sides, respectively, of the rectangular shape.

18. The compactor vehicle of claim 17, wherein the plate further defines a plurality of mass reduction voids that open to a third area of the arcuate surface that is exclusive of the first area, and each void and a portion of the third area is positioned substantially between the two ports of a port pair in the plurality of port pairs.

19. The compaction apparatus of claim 18, wherein the two ports of the port pair and the void therebetween define a footprint, the footprint being one of a plurality of footprints defined by the plate, the lengths of the footprints in the plurality of footprints being approximately equal to one another.

20. The compaction apparatus of claim 1 wherein a plurality of the removable plates are stackable one on top another to form a reduced space stack for packaging shipping and storage.

* * * * *